US006230815B1

(12) United States Patent
Sundholm

(10) Patent No.: US 6,230,815 B1
(45) Date of Patent: May 15, 2001

(54) SPRINKLER OR SPRAY HEAD

(76) Inventor: Göran Sundholm, Ilmari Kiannon kuja 3, Fin-04310 Tuusula (FI)

( * ) Notice: Subject to any disclaimer, the term of this patent is extended or adjusted under 35 U.S.C. 154(b) by 0 days.

(21) Appl. No.: 09/445,339

(22) PCT Filed: Jun. 11, 1998

(86) PCT No.: PCT/FI98/00505

§ 371 Date: Jan. 10, 2000

§ 102(e) Date: Jan. 10, 2000

(87) PCT Pub. No.: WO98/56463

PCT Pub. Date: Dec. 17, 1998

(30) Foreign Application Priority Data

Jun. 13, 1997 (FI) ..... 972537
Jun. 2, 1998 (FI) ..... 981249

(51) Int. Cl.[7] ..... A62C 37/08

(52) U.S. Cl. ..... 169/37; 169/19; 169/38; 169/41; 169/42; 169/56; 169/57

(58) Field of Search ..... 169/19, 37, 38, 169/39, 41, 42, 56, 57

(56) References Cited

U.S. PATENT DOCUMENTS

| | | | | |
|---|---|---|---|---|
| 4,508,175 | | 4/1985 | Pieczykolan | 169/38 |
| 4,618,002 | | 10/1986 | Mears | 169/37 |
| 4,664,198 | | 5/1987 | Johnson | 169/38 |
| 4,715,447 | | 12/1987 | Johnson | 169/37 |
| 5,188,185 | * | 2/1993 | Mears | 169/37 |
| 5,257,827 | | 11/1993 | Takeuchi et al. | 169/41 |
| 5,513,708 | * | 5/1996 | Sundholm | 169/37 |
| 5,944,113 | * | 8/1999 | Sundholm | 169/37 |

FOREIGN PATENT DOCUMENTS

| | | | | |
|---|---|---|---|---|
| 3032791 | * | 4/1982 | (DE) | 169/56 |
| 3816917 | * | 11/1989 | (DE) | 169/56 |
| 9531252 | | 11/1995 | (WO) . | |

* cited by examiner

*Primary Examiner*—Andres Kashnikow
*Assistant Examiner*—Robin O. Evans
(74) *Attorney, Agent, or Firm*—Ladas and Parry

(57) ABSTRACT

The invention relates to a sprinkler or a spray head comprising a housing (2), an inlet (3), a nozzle (4) mounted in the housing, a passage (17-18-13) from the inlet to the nozzle, and a holder (8) for a release means, the holder being mounted in front of the nozzle so that it prevents the nozzle from spraying extinguishing medium forward without hindrance, the nozzle being arranged to spray extinguishing medium once the release means has been released. The holder (8) is mounted in the housing (2) by means of a locking mechanism, which is arranged to open and release the holder (8) from the housing once the release means (7) has been released. To allow efficient and forceful spraying of the extinguishing medium without that the holder stands in the way, reducing the momentum and penetration force of the jet, and to safeguard the operation, the spinkler or spray head comprises a spindle (9) which is arranged to move in the housing (2) from a first position, in which the spindle is arranged to close the passage (17-18-13) to keep the nozzle (4) closed, to a second position, in which the spindle is arranged to open the passage to keep the nozzle open, when the release means is being released, the spindle being arranged to exert a force on the locking mechanism and to open the locking mechanism when the spindle is moved toward the holder (8) into the second position, whereby the nozzle (4) can forcefully spray the extinguishing medium forward essentially without hindrance.

16 Claims, 3 Drawing Sheets

SPRINKLER OR SPRAY HEAD

BACKGROUND OF INVENTION

The invention relates to a sprinkler or a spray head comprising a housing, an inlet, a nozzle mounted in the housing, a passage from the inlet to the nozzle, and a holder for a release means, the holder being mounted in front of the nozzle so that it prevents the nozzle from spraying extinguishing medium forward without hindrance, the nozzle being arranged to spray extinguishing medium once the release means has been released, the holder being mounted in the housing by means of a locking mechanism, which is arranged to open and release the holder from the housing once the release means has been released.

The problem in the sprinklers of the above type is that the holder or some other part of the sprinkler always operates as an extinguishing-medium distributor, thus resisting the jet of extinguishing medium. Yet it is often desired that the nozzle can spray extinguishing medium without hindrance once the sprinkler has been released. If the extinguishing medium is water mist and the water mist hits the holder, the jet of extinguishing medium loses speed and momentum as the droplets gain in size. This is usually a drawback, since the aim is to spray water mist with a very small droplet size and, according to modern fire fighting technology, with high momentum and penetration capacity. Such an extinguishing medium absorbs heat very efficiently, and is simultaneously able to penetrate into the seat of fire. The longer the distance between sprinklers in a sprinkler system, the more important it is that individual sprinklers can spray directly forward, i.e. downward; otherwise a seat of fire directly under a sprinkler may expand, whereby the fire becomes more difficult to extinguish.

U.S. Pat. No. 4,618,002 discloses a sprinkler with such a design and structure that it can be embedded in the ceiling in an aesthetically pleasing manner. The sprinkler comprises a holder with a locking mechanism that opens in connection with the release as the release means melts. The locking mechanism comprises a spring, whose operation is crucial to the operation of the sprinkler. Whether or not the mechanism operates can be considered uncertain as the sprinkler has been unused for years, and, for example, the locking mechanism has dirtied and corrosion may have hampered the properties and operation of the spring. The sprinkler comprises a deflector, which prevents the extinguishing medium from being sprayed directly forward without hindrance when the sprinkler has been released.

U.S. Pat. No. 5,257,827 discloses a sprinkler comprising a valve that opens in connection with the release so as to direct the jet of extinguishing medium to the side. In this previously known sprinkler, the jet of extinguishing medium cannot be sprayed directly forward without hindrance.

U.S. Pat. No. 4,664,198 discloses a sprinkler with a locking mechanism that opens in connection with the release. A deflector prevents the extinguishing medium from being sprayed forcefully directly forward when the sprinkler is released.

BRIEF DESCRIPTION OF INVENTION

The primary object of the present invention is to provide a new sprinkler or spray head which does not involve the above drawbacks. The secondary object of the invention is to provide a sprinkler or spray head that allows the liquid flow to increase more with the increase in pressure than the earlier solutions by providing a structure that essentially changes the resistance value, so-called k-value, of a nozzle as the pressure changes.

The primary object is achieved by an invention which is characterized by a spindle being arranged to move, when the release means is being released, from a first position in the housing, in which the spindle is arranged to close the passage so as to keep the nozzle closed, to a second position, in which the spindle is arranged to open the passage so as to keep the nozzle open, the spindle being arranged to exert a force on the locking mechanism and, by moving toward the holder into the second position in connection with the release, to open the locking mechanism so that the nozzle can spray extinguishing medium forcefully forward essentially without hindrance. The sprinkler preferably comprises a spring-loaded spindle, which is arranged to move in the housing from a first position, in which the nozzle is closed, to a second position, in which the nozzle is open, whereby the spindle is arranged to exert a force on the locking mechanism and open it after the release means has been released and by moving the spindle toward the holder. A preferred, simple implementation is that the locking mechanism comprises at least two elements that can be inserted partly into recesses made in the housing and partly into recesses made in the holder.

The secondary object of the invention can be achieved with a sprinkler in which the nozzle is a central nozzle, the sprinkler further comprising a number of nozzles arranged obliquely on the side, each in its own nozzle housing, the nozzles arranged obliquely on the side each comprising an inlet end and a first conduit from the inlet end to a nozzle opening for spraying extinguishing medium from the nozzle, and the nozzle comprising a second conduit for spraying extinguishing liquid from the nozzle, a spring-loaded valve element being arranged in the conduit to keep the second conduit closed when a first pressure acts on the nozzle on account of the extinguishing liquid, the valve element being arranged to open the second conduit when a second pressure acts on the valve element, the second pressure being higher than the first pressure.

The preferred embodiments of the invention appear from appended claims 2 to 16.

The main advantages of the sprinkler according to the invention are that the sprinkler allows spraying of extinguishing medium without hindrance with a great force, penetration and momentum when the release means has been released. Further, a preferred embodiment of the invention allows the liquid flow of extinguishing medium to increase heavily as the pressure of the extinguishing medium increases.

BRIEF DESCRIPTION OF DRAWINGS

In the following the invention will be described by means of a preferred embodiment with reference to the attached drawing in which.

DETAILED DESCRIPTION OF INVENTION

Figure 1:
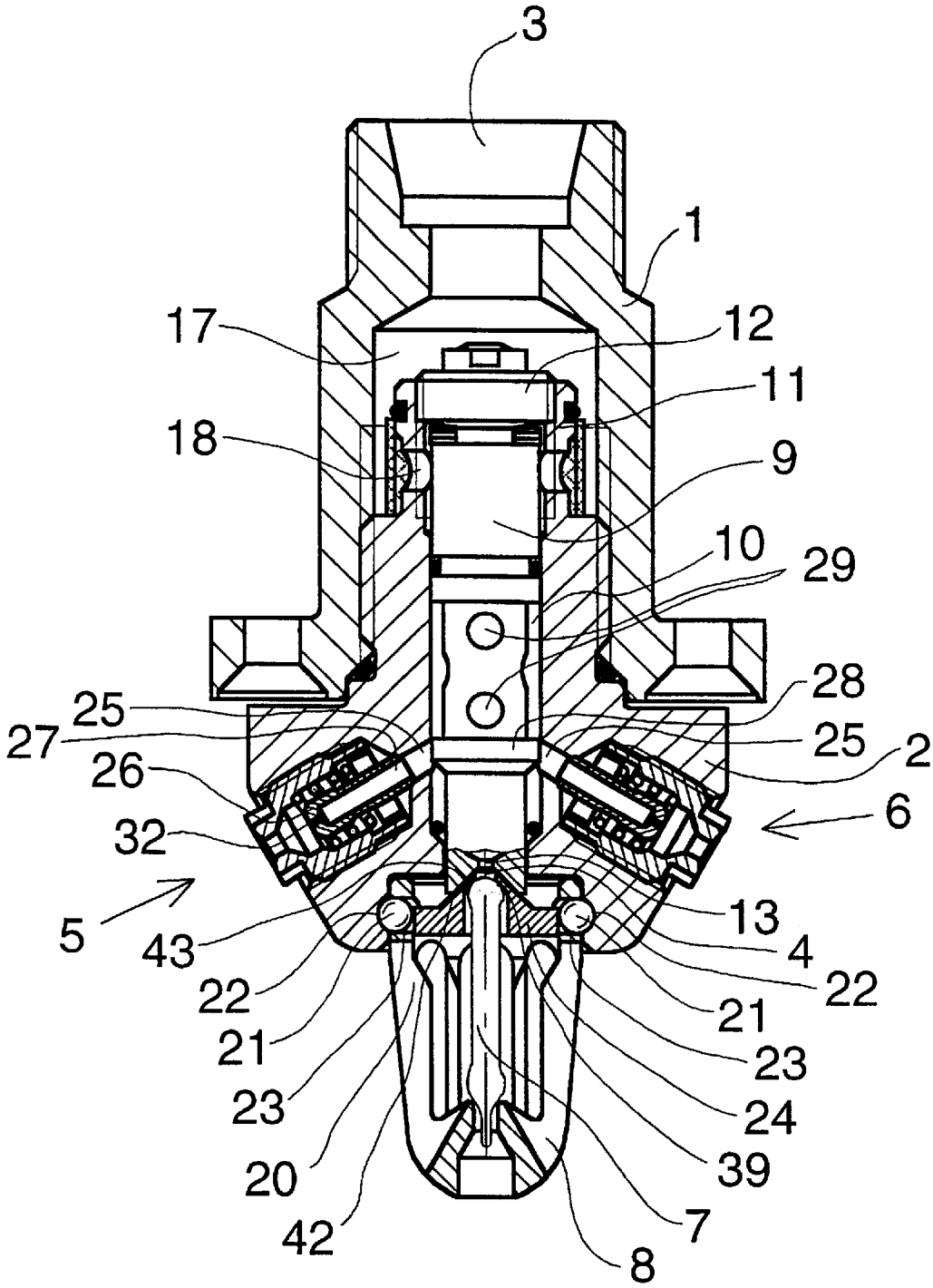
FIG. 1 shows a sprinkler in a standby mode.

FIG. 1 shows a sprinkler comprising a mounting element 1, a housing 2 screwed into the mounting element, an inlet 3, a central nozzle 4, a number, for example 2 to 8, of obliquely arranged nozzles 5, 6 and a release means, which is a glass ampoule 7 or the like, which will explode or melt at a high temperature, releasing the sprinkler. The ampoule 7 is mounted in a holder 8 positioned in front of the nozzle so that the lower end of the ampoule rests on the free end of the holder and the upper end of the ampoule rests on the nozzle 4. The holder 8 has openings on the side, whereby the ampoule is able to react quickly to a rising temperature.

The inlet 3 is situated in the mounting element 1 for mounting the sprinkler, for example, in the ceiling.

In the housing 2 is mounted a spindle 9, which is arranged to slide in a conduit 10 provided in the housing. A spring, preferably a cup spring 11 strained between the spindle and an end part 12 in the housing 2 is arranged to exert a force in the standby mode on the spindle 9 and to press the spindle against the ampoule 7 via an element 24 (stopping element 24). The spring 11 is not necessary: its function can be performed by an area of the spindle 9, the area being subjected to the pressure of the extinguishing medium prevailing in the inlet 3. Preferably partial or alternatively full balancing of the extinguishing medium pressure is here possible, as described, for example, in WO 95/31252 and WO 92/15370. The balancing could be described as being at least mainly balanced.

In the spindle 9 there is a central conduit 13, in which is mounted a pin 14, around which is arranged a helical spring 15. The helical spring 15 is arranged, with a little play, between the pin 14 and the wall of the central conduit 13 so that after the release of the sprinkler the extinguishing medium flows along a spiral-shaped path 16 that follows the loops of the helical spring. The speed and force of the extinguishing medium outlet from the nozzle 4 are thereby great. The extinguishing liquid flows from the inlet 3 to the nozzle 4 along a conduit indicated by reference numbers 17-18-13-12-10-19.

The holder 8 is fastened to the housing by a locking mechanism, which is indicated generally by reference number 20 and which comprises six balls 21, the balls being inserted into corresponding recesses 22 in the housing 2 at most half of their diameter, and the holder comprising recesses or holes 23 for them.

A stopping element in the form of a washer-like plate 24 is mounted in the lower end of the spindle 9. The plate 24 has preferably a wedge-shaped or cone-shaped seat 39 for receiving the ampoule 7 so that the ampoule comes into contact with the seat. Because the ampoule 7 is in contact with the plate 24, the parts, including the plate, stay in correct position when the sprinkler is in the standby mode. Thus the plate cannot be unintentionally detached by shaking or move into an oblique position, for example, during the transport of the sprinkler. The shape of a wedge or a cone allows the ampoule 7 to be centred on the plate 24 and the entire sprinkler. The plate 24 also comprises a conical surface 42 that fits to a corresponding conical surface 43 in the lower end of the spindle 9. The conical surfaces 42, 43 can be called centring surfaces, since they centre the plate 24 on the spindle 9.

The plate 24 prevents the balls 21 from being displaced from the recesses 22 and thereby the release of the holder 8 from the housing 2 when the ampoule 7 is intact.

The housing 2 comprises oblique branching conduits 25 for leading the extinguishing medium from conduit 10 toward a valve element 26 arranged in the nozzles 5, 6 and having a central conduit 27. The spindle 9 comprises a piston-like part 28 which covers the oblique conduits 25 in the standby mode of the sprinkler so that the extinguishing medium cannot flow into the conduits 25. The openings 29 lead from the spindle conduit 13 to conduit 10.

Figure 5:
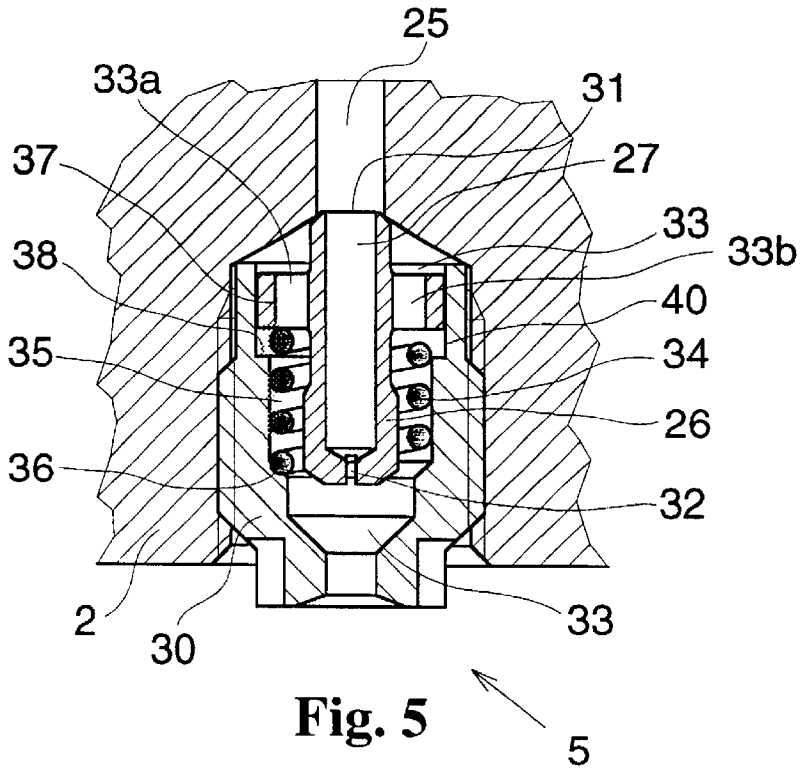
FIGS. 5 and 6 show an enlarged view of a nozzle of the sprinkler of FIG. 1 in a first and a second working mode.

Each nozzle 5, 6 arranged obliquely on the side, the number of the nozzles being preferably from 4 to 8, is mounted in a nozzle housing 30 in the housing 2 of the sprinkler, see FIGS. 1 and 5. The nozzles 5, 6 comprise an inlet end 31 for the extinguishing medium and a nozzle opening 32 connected to the inlet end by a conduit 27.

The nozzles 5, 6 comprise a second conduit 33 for spraying extinguishing medium. The valve element 26 is arranged in the conduit 33, the valve element being loaded by a helical spring 34, which keeps the conduit closed when the sprinkler is in the standby mode, i.e. when only a little or no extinguishing medium pressure acts on the conduit 27 and the valve element. The valve element 26 is arranged to open the conduit 33 when a sufficiently high extinguishing medium pressure acts on the valve element. On account of the conduit 33, the flow of extinguishing medium through the nozzles 5, 6 greatly increases with the increase of the extinguishing medium pressure. This makes it possible to use the source of extinguishing medium (not shown) more efficiently when a few sprinklers of a larger group of sprinklers are released.

The valve element 26 is a sleeve-shaped part in which a conduit 27 is arranged centrally. The helical spring 34 is arranged, with a little play, around the valve element 26 in conduit 33 so that the loops of the helical spring define between them a spiral-shaped path 35 for the extinguishing medium. The path 35, which is a part of conduit 33, sets the extinguishing medium in efficient whirling motion so that it discharges from the nozzle 5, 6 forcefully.

The helical spring 34 rests at one end on a shoulder 36 in the nozzle housing 30 and at the other end on a flange-like part 37 of the valve element 26. The flange-like part 37 comprises through-holes 33*a*, 33*b* so that the conduit 33 can operate and be open when the valve element 26 moves downward. The flange-like part 37 rests slidably on a wall 40 of the nozzle housing 30. To prevent the valve element 26 from moving at a high extinguishing medium pressure so far toward the opening of the nozzle 5 that the conduit 33 would be closed, the nozzle housing 30 comprises a shoulder 38.

In the following the operation of the sprinkler is described with reference to the figures. For the sake of simplicity, nozzles 5, 6 are not presented as sectional views in FIGS. 2 to 4, and FIG. 1 does not show the pin 14, with a spring 15 around it, arranged in the spindle conduit 13.

Figure 2:
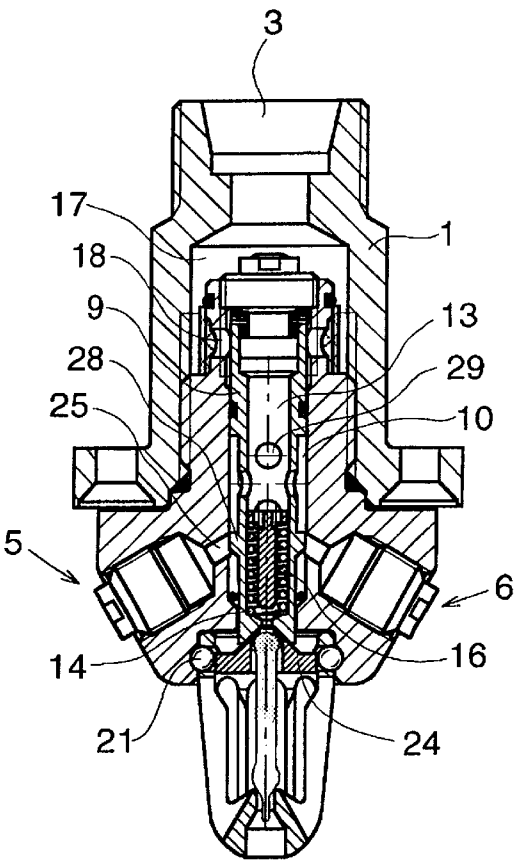

When the sprinkler is in the standby mode, as shown in FIGS. 1, 2 and 5, the extinguishing medium cannot flow from the inlet 3 to a nozzle 5, 6, 4 of the sprinkler.

In the event of fire, the ampoule 7 becomes so hot that it explodes. By the action of the spring 11, conduit 17-18-13 is opened and the extinguishing medium starts to flow from the inlet 3 to the nozzle 4 and is then discharged through the nozzle (cf. FIG. 3, which shows the sprinkler in the released mode). Because the ampoule cracks, the spring 11 presses the spindle 9 downward so that the piston-like part 28 opens the branching conduits 25. The extinguishing medium starts to flow from the inlet 3 through the conduits 25 to the nozzles 5, 6 and is then discharged through the nozzles (cf. FIG. 3). If there is no spring 11, an area of the spindle 9 that is perpendicular to the longitudinal direction of the spindle 9 and is subjected to the extinguishing medium pressure can be used. The area can, for example, be the area that is formed by the upper edge 41 of the spindle (see FIG. 3).

Figure 4:
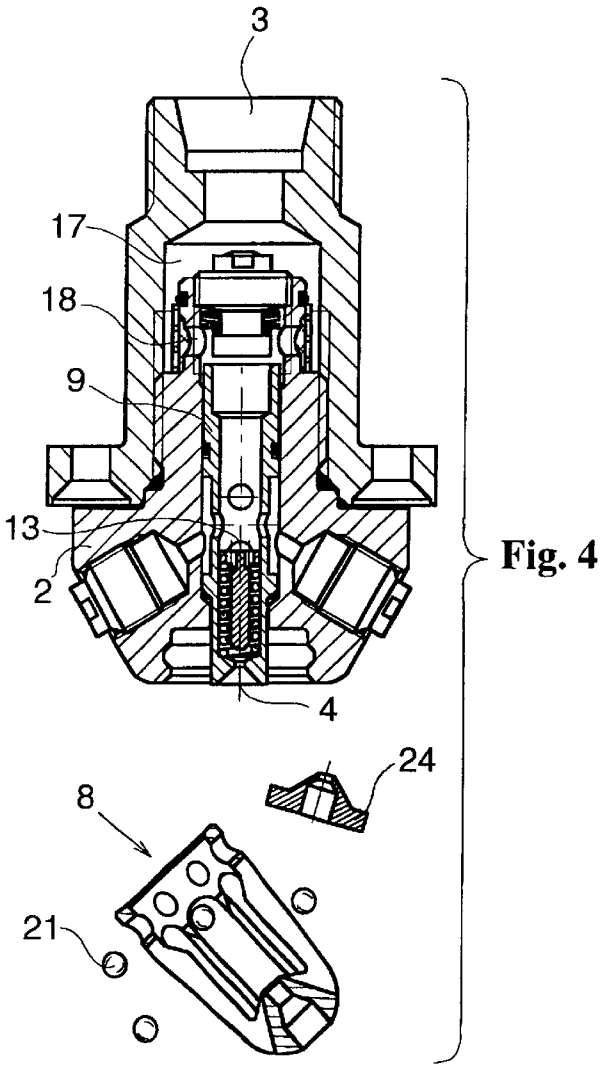
FIGS. 2 to 4 show the sprinkler of FIG. 1 in a standby mode, in a first released mode and in a second fully released mode.
Figure 3:
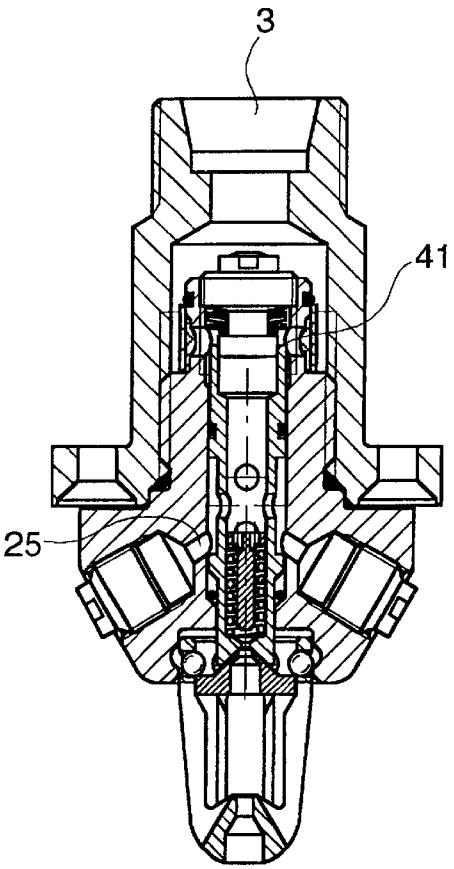
Figure 6:
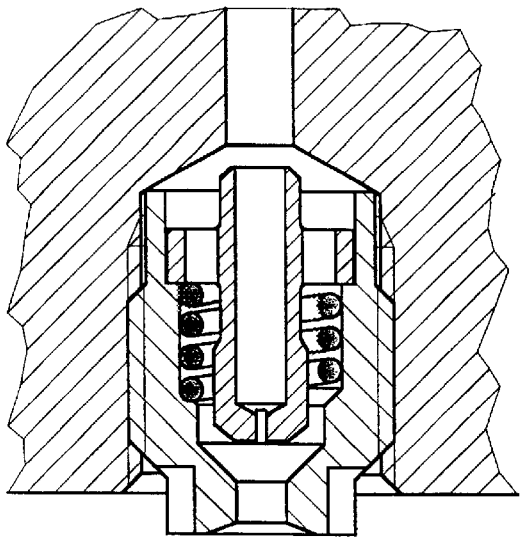

In connection with the release, because the pressure-balancing stops, the extinguishing medium pressure, for example 200 bar, exerts a great force on the spindle 9, the force thrusting out the holder with the locking mechanism 20. FIG. 3 shows that when the spindle 9 is moved downward, the plate 24 is also moved downward, so that the balls 21 are displaced from the recesses 22. The displacement happens automatically, since in the standby mode of the sprinkler the balls 21 are inserted into the recesses 22 at most half of their diameter, and the holder 8 pulls the balls with it when it is moved downward by the spindle 9. In principle, it is possible to effect the displacement of the balls 21 in another way, for example, by gravity, but this does not guarantee efficient and reliable operation. Since the holder 8 is fastened to the housing 2 only by means of the balls 21, the holder falls down as shown in FIG. 4, which illustrates the spray head in a fully released mode. In the mode illustrated in FIG. 4, the sprinkler can spray the extinguishing medium forcefully toward the fire so that the extent of the jet is long and without that the holder 8 impairs the momentum of the extinguishing medium coming from the central nozzle 4. Together, the nozzles 5, 6 and 4 provide a strong jet. The extinguishing medium is preferably water mist. When a high pressure, for example 30 to 300 bar, is used, it is also possible to provide a similar concentration of jets from different nozzles as in WO 92/20453. Particularly at a high pressure an especially strong jet is provided as the conduit 33 in nozzles 5, 6 is also opened so that the extinguishing medium flows through both conduits 27 and 33 while liquid is sprayed through the nozzle 4. Depending on the pressure of the extinguishing medium, the valve element 26 settles at different levels so that at a low pressure the valve element takes the position shown in FIG. 5 and at a high pressure the position shown in FIG. 6.

The invention has been described above with reference to only one embodiment. The invention, however, can vary in its details in many ways within the scope of the attached claims. The locking mechanism moving the holder 8 to the side can thus vary: for example, the balls can be replaced with other types of locking elements. The stopping element 24 need not be a plate; it can be, for example, a spring member that follows the movement of the spindle or a member that folds into a groove when the spindle is moved. The oblique nozzles 5, 6, each with two conduits, are not necessary, but they help to achieve good results. Further, a spring 5 is not necessarily needed in the spindle 9.

What is claimed is:

1. A sprinkler or a spray head comprising a housing (2), an inlet (3), a nozzle (4) mounted in the housing, a passage (17-18-13) from the inlet to the nozzle, and a holder (8) for a release means (7), the holder being mounted in front of the nozzle so that it prevents the nozzle from spraying extinguishing medium forward without hindrance, the nozzle being arranged to spray extinguishing medium once the release means has been released, the holder (8) being mounted in the housing (2) by means of a locking mechanism (20), which is arranged to open and release the holder (8) from the housing once the release means (7) has been released, a spindle (9) being arranged to move, when the release means (7) is being released, from a first position in the housing, in which the spindle is arranged to close the passage so as to keep the nozzle closed, to a second position, in which the spindle is arranged to open the passage so as to keep the nozzle open, the spindle (9) being arranged to exert a force on the locking mechanism (20) and, by moving toward the holder (8) into the second position in connection with the release, to open the locking mechanism so that the nozzle (4) can spray extinguishing medium, characterized by the spindle (9) comprising a conduit (13) leading to the nozzle (4) and forming part of the passage (17-18-13) so that the nozzle can spray extinguishing medium forcefully forward essentially without hindrance when the spindle is in the second position.

2. A sprinkler according to claim 1, characterized in that in the first position the spindle (9) is loaded by a spring (11) toward the holder (8).

3. A sprinkler according to claim 1, characterized in that the spindle (9) is at least mainly pressure-balanced in the first position.

4. A sprinkler according to claim 1, characterized in that in the second position the spindle (9) is arranged to exert a force on the holder by means of the pressure of the extinguishing medium in the passage (17-18-13).

5. A sprinkler according to claim 1, characterized in that the locking mechanism (20) comprises at least two elements (21) that can be inserted partly into recesses (22) made in the housing (2) and partly into recesses (23) made in the holder (8).

6. A sprinkler according to claim 5, characterized in that the elements are balls (21), and they are arranged to be inserted into the recesses (22) in the housing (2) at at most half of their diameter, whereby that end of the spindle (9) which is on the side of the holder (8) comprises a stopping element (24), which is arranged to prevent the balls from being displaced from the recesses (22) in the housing (2) when the spindle is in the first position, in which the release means (7) is intact, and which is arranged to move toward the distal end of the holder and thereby allow the balls to be displaced from the recesses in the housing.

7. A sprinkler according to claim 6, characterized in that the stopping element (24) comprises a seat (39) for receiving the release means (7), the release means biasing the seat when the spindle (9) is in its first position.

8. A sprinkler according to claim 7, characterized in that the stopping element (24) and the end of the spindle (9) facing the holder (8) comprise conical centring surfaces (42, 43) placed against each other so as to centre the stopping element on the spindle (9).

9. A sprinkler according to claim 1, in which the nozzle is a central nozzle (4) in the sprinkler and the sprinkler further comprises a number of nozzles (5, 6) arranged obliquely on the side, each in its own nozzle housing (30), characterized by the nozzles (5, 6) arranged obliquely on the side each comprising an inlet end (31) and a first conduit (27) from the inlet end to a nozzle opening (32) for spraying extinguishing medium from the nozzle, and the nozzle comprising a second conduit (33) for spraying extinguishing medium from the nozzle, a spring-loaded (34) valve element (26) being arranged in the second conduit to keep the second conduit closed when a first pressure acts on the valve element on account of the extinguishing medium, the valve element being arranged to open the second conduit when a second pressure acts on the valve element on account of the extinguishing medium, the second pressure being higher than the first pressure.

10. A sprinkler according to claim 9, characterized in that the first conduit (27) is arranged in the valve element (26).

11. A sprinkler according to claim 9, characterized in that the spring is a helical spring (34) arranged around the valve element (26) in the second conduit (33).

12. A sprinkler according to claim 11, characterized in that the helical spring (34) is arranged, with a little play, in the nozzle housing (30) and around the valve element (26) so that the loops of the helical spring define between them a spiral-shaped path (35) for the extinguishing medium.

13. A sprinkler according to claim 11, characterized in that the helical spring (34) is arranged to rest at its one end on a shoulder (36) in the nozzle housing (30) and at its other end on a flange-like part (37) formed in the valve element (26).

14. A sprinkler according to claim 13, characterized in that the flange-like part (37) is arranged to rest slidably on a wall (40) provided in the nozzle housing (30).

15. A sprinkler according to claim 13, characterized in that the nozzle housing (30) comprises a shoulder (38) to restrict the movement of the flange-like part (37) and the valve element (26) so that the spiral-shaped path (35) remains as it is between the loops of the helical spring (34) although at the second pressure the valve element (26) is subjected to a force that is greater than the counterforce of the helical spring when the helical spring is compressed.

16. A sprinkler according to claim 9 wherein the spindle comprises a spring-loaded (11) spindle (9) arranged centrally in the housing (2), the central nozzle (4) being arranged in the lower end of the spindle, the spindle being supported slidably in a conduit (10) in the housing (2) and the spindle conduit (13) leads to the central nozzle, characterized in that a pin (14) is arranged in the spindle conduit (13) and around the pin is arranged a helical spring (15), the pin and the helical spring defining a spiral-shaped path (16) for the extinguishing medium.

* * * * *